United States Patent [19]

Stinebaugh

[11] Patent Number: 4,558,671

[45] Date of Patent: Dec. 17, 1985

[54] SUPERCHARGED ENGINE

[76] Inventor: Donald E. Stinebaugh, 232 N. Corbin Rd., Post Falls, Id. 83854

[21] Appl. No.: 513,465

[22] Filed: Jul. 13, 1983

Related U.S. Application Data

[63] Continuation-in-part of Ser. No. 504,890, Jun. 16, 1983, abandoned.

[51] Int. Cl.[4] ..... F02B 33/14; F02B 75/02

[52] U.S. Cl. ..... 123/317; 123/318

[58] Field of Search ..... 123/317, 318, 310, 197 A, 123/73 A, 73 AF, 73 PP, 74 A, 74 AE

[56] References Cited

U.S. PATENT DOCUMENTS

| | | | |
|---|---|---|---|
| 931,976 | 8/1909 | Turner | 123/317 |
| 1,018,276 | 2/1912 | Smith | 123/317 |
| 1,311,148 | 7/1919 | Moore | 123/310 |
| 1,452,011 | 4/1923 | Watton | 123/73 F |
| 3,859,968 | 1/1975 | Stinebaugh | 123/317 |
| 4,459,945 | 7/1984 | Chatfield | 123/197 A |
| 4,481,909 | 11/1984 | Takada | 123/73 F |

FOREIGN PATENT DOCUMENTS

| | | | |
|---|---|---|---|
| 2847731 | 5/1980 | Fed. Rep. of Germany | 123/318 |
| 30475 | of 1910 | United Kingdom | 123/317 |
| 511596 | 11/1937 | United Kingdom | 123/318 |

*Primary Examiner*—Ronald H. Lazarus

*Attorney, Agent, or Firm*—John P. Dellett

[57] ABSTRACT

A four-stroke internal combustion engine is supercharged by admitting fuel-air mixture into the engine crankcase and compressing the mixture on the down stroke of the piston. The engine cylinder, and the piston disposed therewithin, are of stepped configuration defining a combustion chamber above a smaller, top piston portion, and an annular chamber above a larger, lower piston portion. Compressed mixture from the crankcase is admitted to a pressure reservoir for supply to the combustion chamber via an intake valve and a throttle valve. The crankcase is either supplied with fuel-air mixture from the annular chamber, or supplies fuel-air mixture to the reservoir via the annular chamber, so as to provide two stages of compression.

12 Claims, 14 Drawing Figures

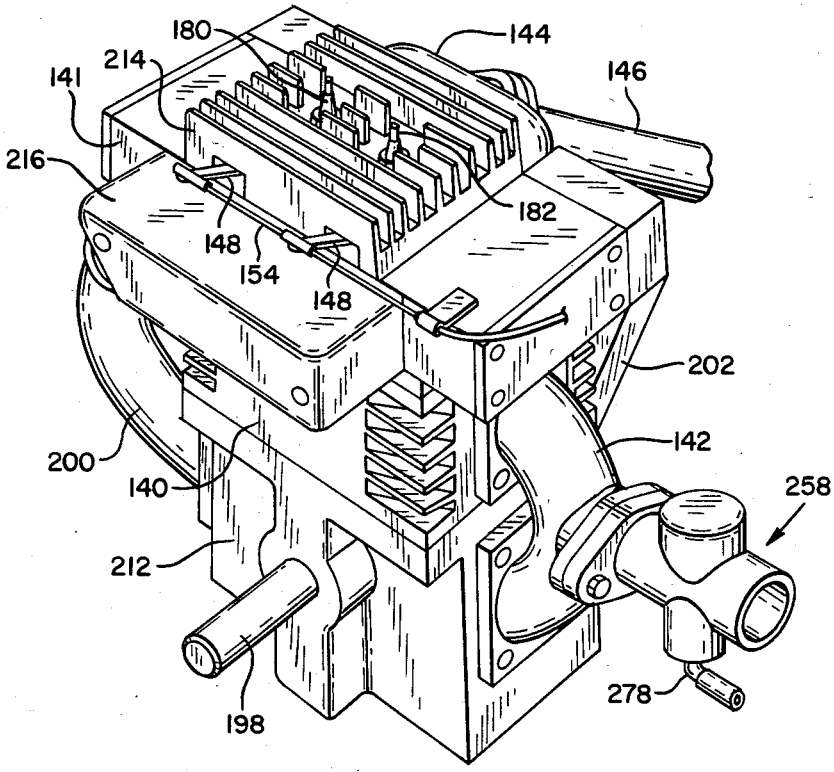
FIG. 7
FIG. 8
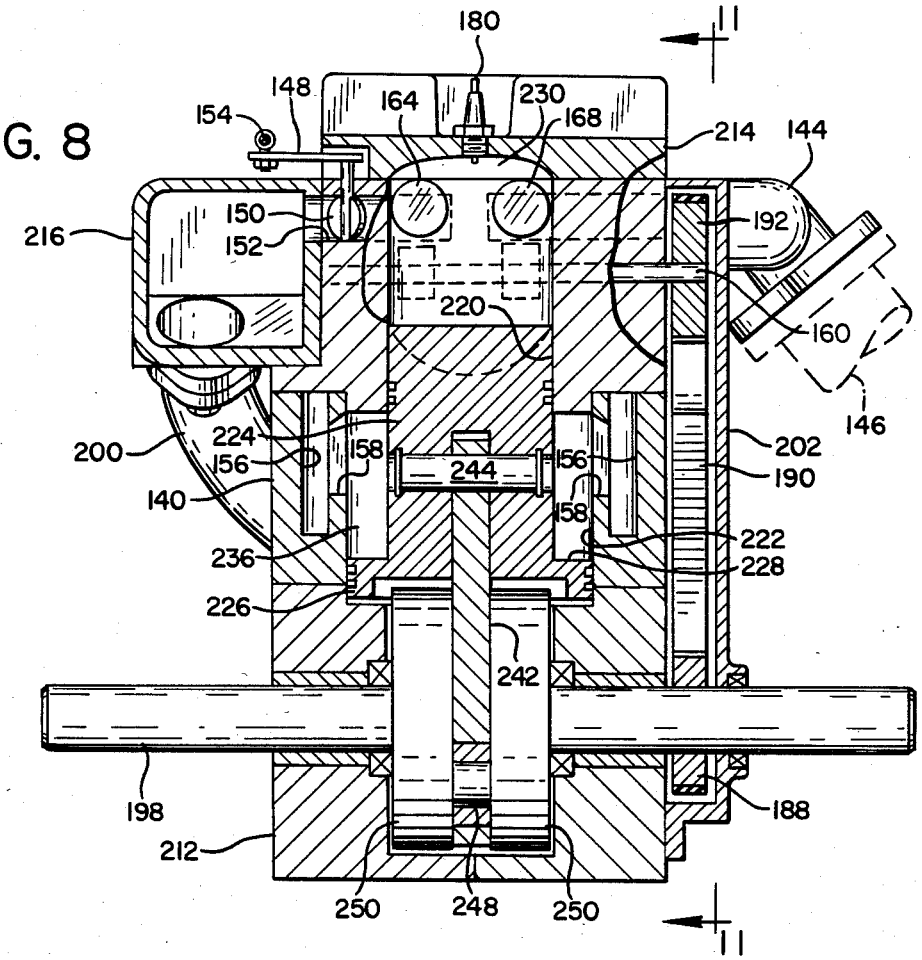

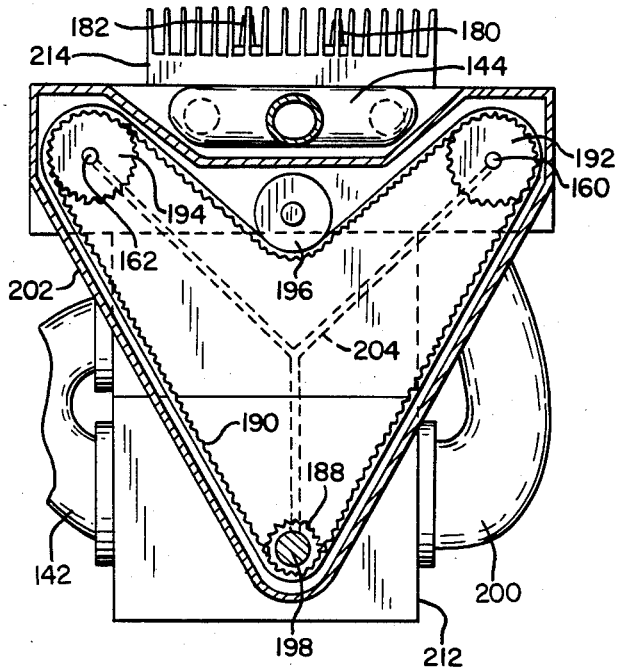
FIG. 11
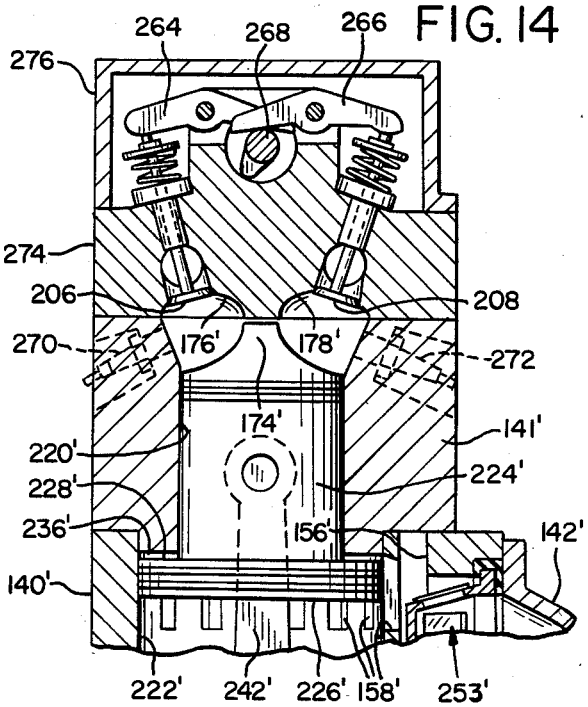
FIG. 14
FIG. 12
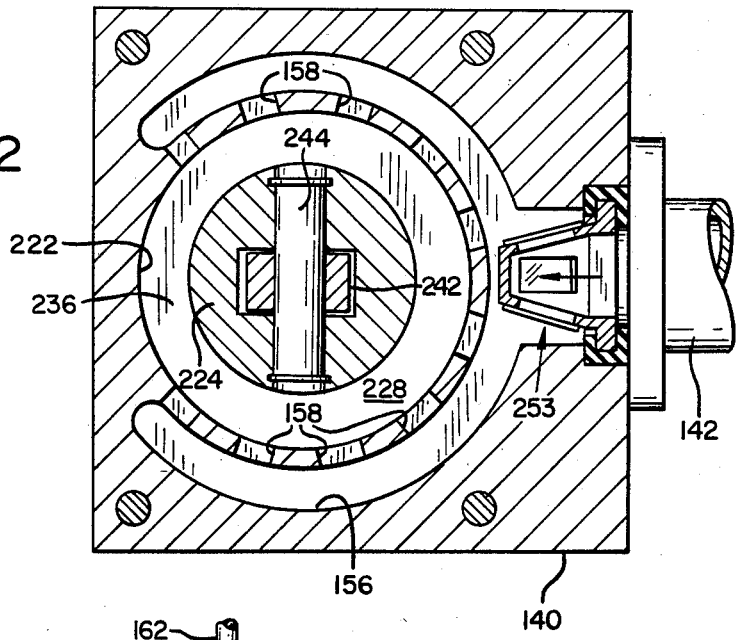
FIG. 13
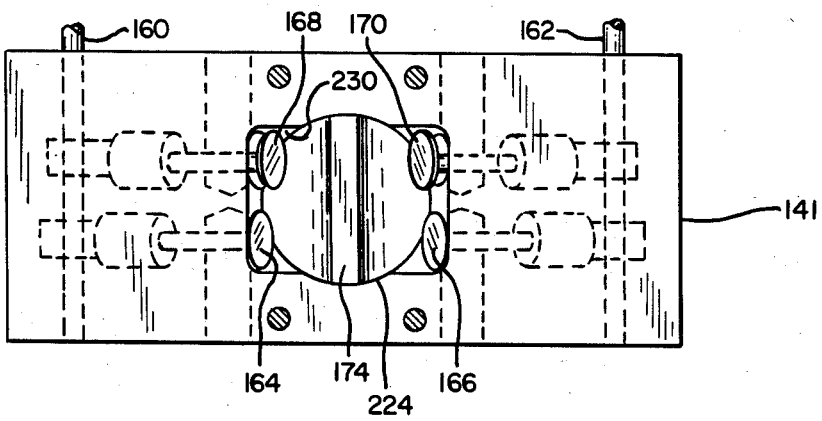

SUPERCHARGED ENGINE

CROSS-REFERENCE TO RELATED APPLICATION

This is a continuation-in-part of my application entitled SUPERCHARGED ENGINE executed by me on May 18, 1983 and filed June 16, 1983, Ser. No. 504,890 now abandoned.

BACKGROUND OF THE INVENTION

The present invention relates to internal combustion engines and particularly to a supercharged engine requiring a minimum of external equipment.

Supercharged engines are known which employ a turbine or other external pump for compressing air or fuel-air mixture before delivery to the engine's combustion chamber. The additional equipment is space consuming, and is sometimes difficult to regulate. Some four-stroke supercharged engines, for example as set forth in my prior U.S. Pat. Nos. 3,859,968 and 3,522,797, employ the crankcase chamber of the engine for compressing a fuel-air mixture then supplied to a tank or reservoir under pressure for delivery through valving means to a combustion chamber. While quite efficacious, this type of engine is somewhat limited in the amount or degree of compression which can be secured. For instance, a tank pressure of about 4 or 5 p.s.i. above atmosphere is typical, but it would be desirable to provide higher pressure on the order of 15 p.s.i. or perhaps greater with a minimum of additional equipment.

SUMMARY OF THE INVENTION

In accordance with the present invention in a principal embodiment thereof, a four-stroke internal combustion engine is provided with a two-part piston having a smaller diameter portion, a larger diameter portion, and a stepped cylinder for receiving said piston. The larger diameter portion has greater displacement and compresses the gaseous input, e.g. fuel-air mixture, for delivery to a combustion chamber adjacent the smaller diameter portion of the piston. The larger diameter portion advantageously compresses the gaseous input into the crankcase of the engine. An annular chamber located along the cylinder and closed by the moving larger diameter piston portion desirably either receives the gaseous input from the crankcase and further compresses the same before delivery to the combustion chamber, or supplies gaseous input to the crankcase in the first place to supplement an external source. A reservoir is preferably interposed between the aforementioned annular chamber or the crankcase and the combustion chamber for delivering a compressed gaseous input to the combustion chamber by way of an intake valve on every fourth stroke of the piston.

According to another feature of the present invention, the combustion chamber is provided with a pair of spark plugs for bringing about even burning across the combustion chamber.

According to a further feature of the present invention, the engine is provided with a carburetor which operates on a demand basis in response to inlet suction of the engine.

According to an alternative embodiment of the present invention, the connection with the engine drive shaft is provided by a scotch yoke in place of the more conventional connecting rod.

It is an object of the present invention to provide an improved four-stroke, supercharged, internal combustion engine which is compact and efficient.

It is another object of the present invention to provide an improved supercharged engine that supplies adequate supercharging pressure with a minimum of equipment.

It is another object of the present invention to provide an improved, supercharged, internal combustion engine that is substantially immediately responsive to control.

It is another object of the present invention to provide an improved, supercharged, internal combustion engine which operates with minimized objectionable emissions.

The subject matter which I regard as my invention is particularly pointed out and distinctly claimed in the concluding portion of this specification. The invention, however both as to organization and method of operation, together with further advantages and objects thereof, may best be understood by reference to the following description taken in connection with the accompanying drawings wherein like reference characters refer to like elements.

DRAWINGS

FIG. 7 is a perspective view of an internal combustion engine according to a third and preferred embodiment of the present invention;

FIG. 8 is a vertical cross-sectional view of the FIG. 7 engine taken approximately longitudinally of the engine drive shaft;

FIG. 11 is a rear view, partially broken away, of the FIG. 7 engine;

FIG. 12 is a lateral cross-sectional view of the FIG. 7 engine block taken through an annular chamber thereof at 12—12 in FIG. 10;

FIG. 13 is a top view of the FIG. 7 engine block, looking downwardly with the head removed; and FIG. 14 is a vertical cross-sectional view of an engine according to a yet further embodiment of the present invention.

DETAILED DESCRIPTION

Figure 1:
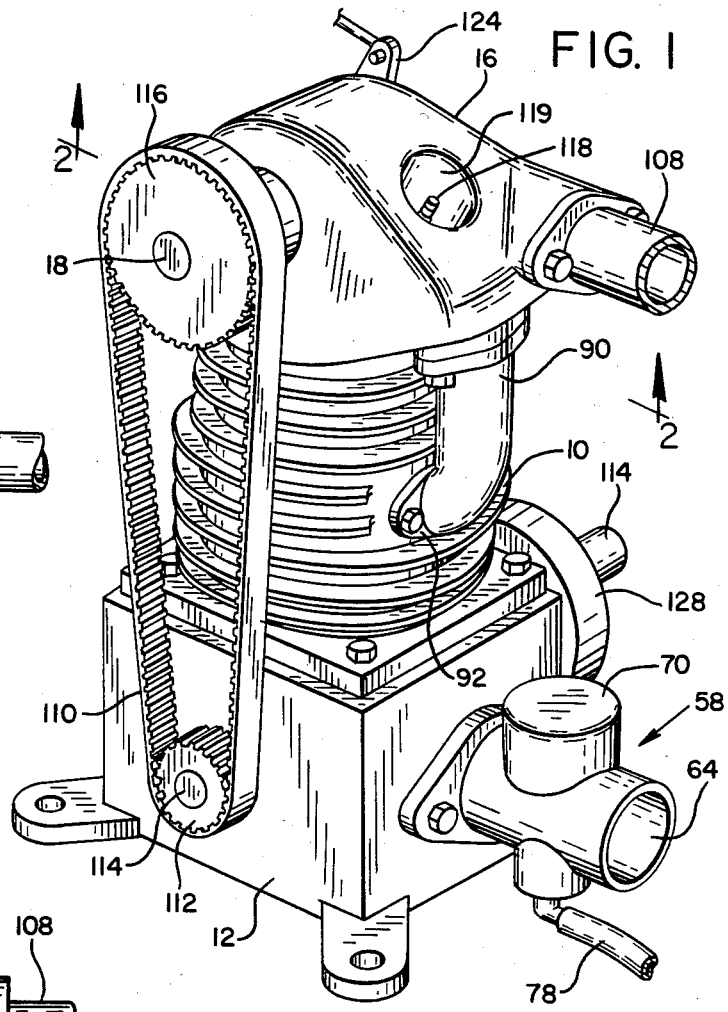
FIG. 1 is a perspective view of an internal combustion engine according to a first embodiment of the present invention.

Referring to FIGS. 1 through 4, a four-stroke, supercharged engine according to one embodiment of the present invention includes a block 10, a crankcase 12 and a head 14 incorporating an intake manifold or reservoir chamber 16, the latter also housing cam shaft 18. The block 10 is provided with an upper bore or cylinder portion 20 and a lower, coaxial counterbore or cylinder portion 22 which is larger in diameter than the first portion. Within the bore and counterbore is received a stepped piston comprising a first smaller diameter portion 24 slidably received in upper bore 20, and a second, larger diameter portion 26 joined to the first and slidably received in counterbore 22, with an upper shoulder 28 being formed at the top of the larger piston portion where the two piston portions join. The piston portion 24 carries piston rings 32, and the piston portion 26 carries rings 34.

A combustion chamber 30 is formed above the smaller piston portion 24 in bore 20, while the region below piston portion 26 in counterbore 22 and in the crankcase is considered to be the crankcase chamber for purposes of the present description.

An intermediate annular chamber 36 is defined within the larger diameter bore 22 and around the smaller diameter piston portion 24 above stepped shoulder 28 of piston portion 26, said chamber being variable in volume according to the position of the lower piston portion. In a preferred form, the area of shoulder 28 at the top of piston portion 26 is substantially equal to the area of the head end 38 of smaller piston portion 24. Thus, the area across the bottom end 40 of piston portion 26 is twice that of head end 38. Consequently, the displacement of the combined piston into the crankcase chamber exceeds the displacement of the piston into either the combustion chamber 30 or the annular chamber 36 and in the particular embodiment is twice as great as the displacement into either chamber 36 or chamber 30.

A connecting rod 42 is joined by wrist pin 44 to the combined piston, and by a bearing 46 to a crank portion 48 of the crankshaft which is carried in crankcase 12. The volume in the crankcase is reduced by providing counterweight stuffer disks 50 which form a part of the crankshaft together with crank portion 48 which connects two disks 50 and spaces the disks to receive the connecting rod therebetween.

A reed valve 52 is disposed in a passage at one side of the crankcase and communicates gaseous mixture into the crankcase from carburetor 58. The reed valve 52 includes a flanged, V-shaped body or insert 54 with passages in each side through which flow is permitted in one direction only by flexible reeds 56 anchored at ends thereof toward the larger portion of the body 54, with the free ends of the reeds seating against a tapered portion of the body. This permits the gaseous mixture to enter the crankcase 12 when the piston moves upwardly, but prevents the backward flow on the downward stroke of the piston. The crankcase is otherwise closed, except as hereinafter described, and consequently the gaseous mixture is compressed as the piston moves downwardly.

The carburetor 58 is provided with a venturi passage 60 defined between an upraised portion 62 on the lower face of inlet conduit 64 and the lower end of a piston 66 having an enlarged head 68 slidably received within vacuum chamber 70 located above the venturi. The lower part of the piston 66 extends through an aperture 72 in the upper wall of conduit 64. Depending from the lower end of piston 66 is a needle valve 74 for closing gasoline supply passage 76 receiving gasoline in a conventional manner from a float chamber via tubing 78. A passage 80 extends within piston 66 from the top of the enlarged head thereof to a cut out portion 82 at the lower end of the piston toward the outlet side of the venturi. As fuel-air mixture is demanded according to the suction of fuel-air mixture through reed valve 52 by the rising piston portion 26, decreased pressure is communicated by way of passage 80 into vacuum chamber 70 causing piston 66 to rise and provide fuel around the needle valve. The fuel-air mixture is thus supplied on demand.

Figure 3:
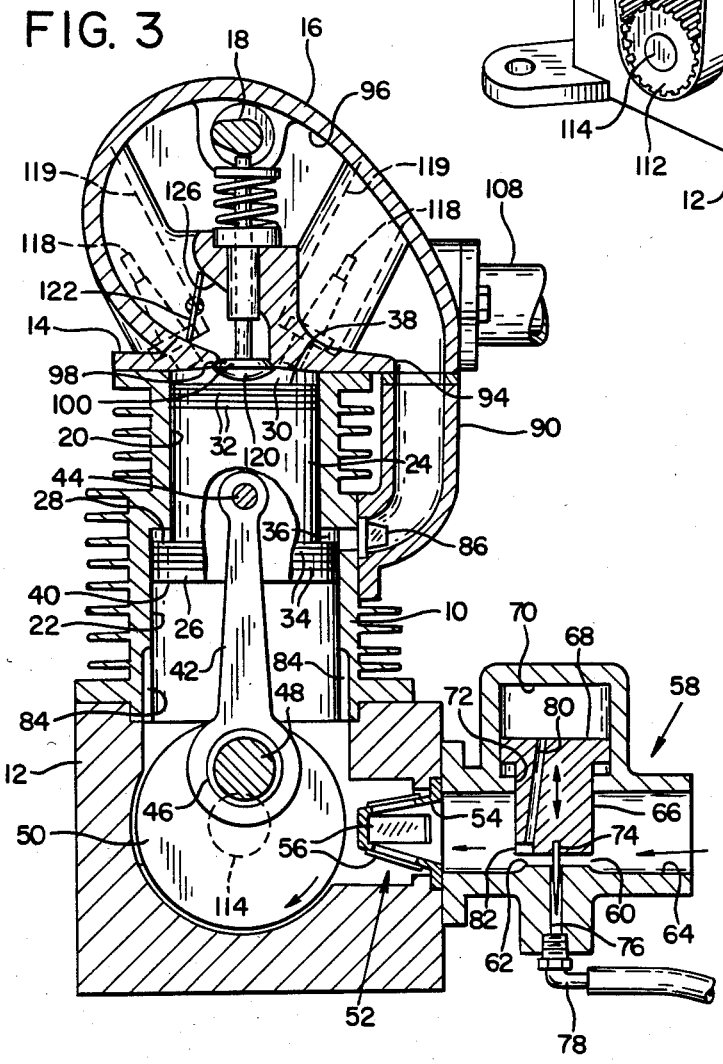
FIG. 3 is a vertical cross-sectional view of the FIG. 1 engine taken through the intake valve and with the piston thereof in the uppermost position.
Figure 4:
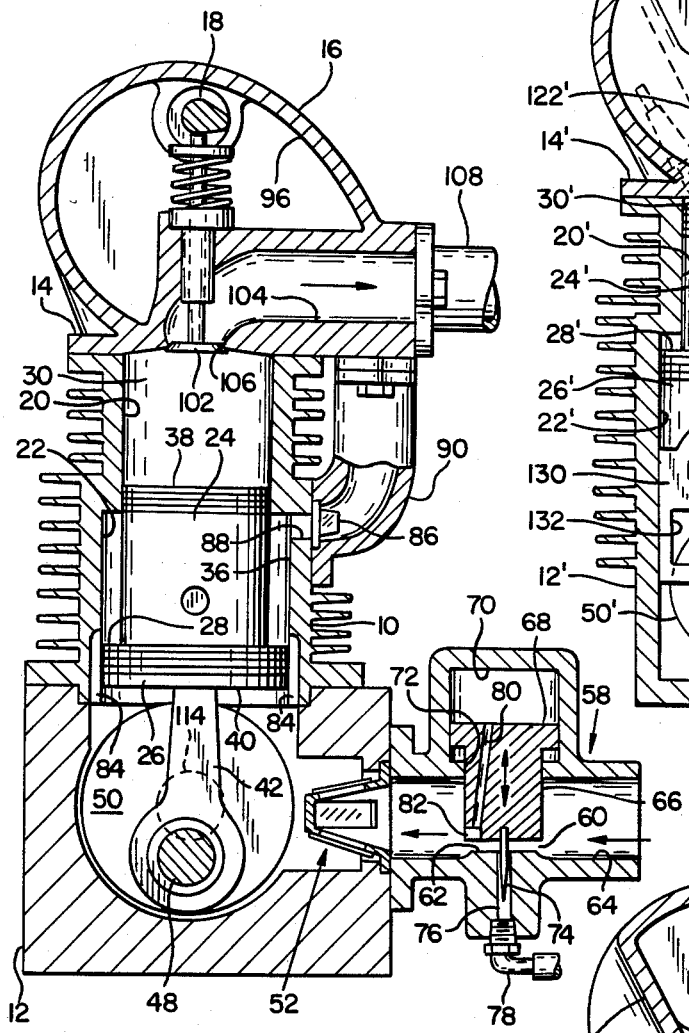
FIG. 4 is a vertical cross-sectional view of the FIG. 1 engine taken through the exhaust valve and showing the piston in its lowermost position.

Valve means is provided for communicating the gaseous mixture compressed in the crankcase chamber from the crankcase chamber into annular chamber 26. This valve means preferably comprises vertical slots or ports 84 in the wall of counterbore 22. FIG. 3 illustrates the farthest upward position of the compound piston 24, 26, e.g. at the end of the compression stroke, and FIG. 4 illustrates the lowermost position of the compound piston, e.g. at the end of the firing stroke. It will be seen that ports 84 communicate between the crankcase chamber and annular chamber 36 as the compound piston approaches its downwardmost position. Thereupon, gaseous mixture from the crankcase chamber is transferred into the annular chamber.

A reed valve 86 is disposed over an aperture 88 located in the upper sidewall of annular chamber 36, with the reeds being directed outwardly such that when the piston portion 26 moves upwardly reducing the volume of annular chamber 36 above piston portion 26, the reed valve will open. A conduit 90 is secured to the block by means of flange 92 and holds the reed valve 86 in position. The upper end of conduit 90 is similarly attached to a lower opening 94 in a side of reservoir 16 which extends outwardly over the block 10. The interior cavity 96 of the reservoir, together with the conduit 90, have smoothly curved walls for directing the mixture in a counterclockwise path around the interior of the reservoir toward intake valve port 98 normally closed by intake poppet valve 100. The internal volume of reservoir 16 including conduit 90 is desirably larger than the upper displacement of either piston portion, e.g. from two to ten times as great, and in any case receives gaseous mixture compressed first by the downward stroke of piston portion 26 into the closed crankcase chamber, and then compressed upwardly by piston portion 26 into reservoir 16. There are two upward compression strokes of the piston portion 26 for every opening of valve 100 in the four-stroke cycle, and it will be seen that the downward stroke displacement of piston portion 26 is twice as great as the upward displacement of piston portion 24. Therefore, the gaseous mixture within reservoir 16 attains a compression of about 15 p.s.i. above atmosphere or greater. In some cases, it is necessary to provide a relief passage (not shown) from the reservoir back into the crankcase chamber for release of pressure or for adjusting the amount of supercharging desired.

The cam shaft 18 journaled within the reservoir 16 is provided with cams for operating intake poppet valve 100 and exhaust poppet valve 102 in a conventional manner against spring pressure. Timing belt 110, driven from gear 112 on drive shaft 114, engages larger gear 116 secured to cam shaft 18 such that the cam shaft 18 rotates at half the speed of the drive shaft for conventional four-stroke cycle operation. The drive shaft also carries flywheel 128. An exhaust passage 104, located within the structure of the reservoir, communicates from exhaust port 106 to an exhaust pipe 108.

Figure 2:
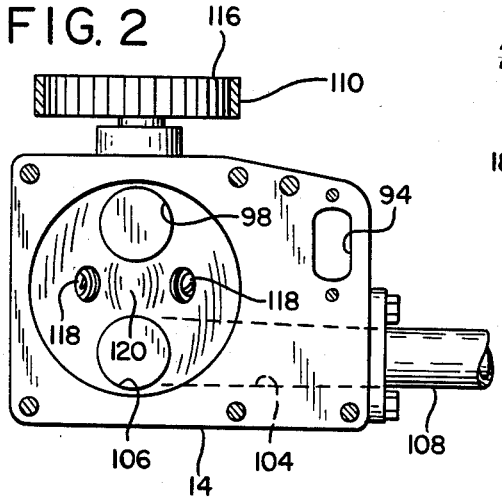
FIG. 2 is a view of the head portion of the internal combustion engine looking upward at 2—2 in FIG. 1.

A pair of spark plugs 118 extend through threaded apertures in head 14 and into the combustion chamber 30, with the body of each of the spark plugs being received in a well 118 protruding through the reservoir 16 to provide access. The spark plugs are fired at substantially the same time, according to the conventional timing for a four-stroke engine, and two are employed at spaced locations opposite the head end 38 of the piston in the combustion chamber. Suitably the spark plug electrodes are situated as illustrated in FIG. 2, with each one approximately diametrically opposite the other on each side of a centerline through the intake and exhaust ports 98 and 106. The utilization of two spark plugs is found to improve combustion, enabling a smoother burn across the combustion chamber with less detonation. The head 14 desirably protrudes slightly downwardly at the top center of the combustion chamber as illustrated at 120, between the respective spark plugs and between the respective ports, to partially divide the combustion chamber into two combustion regions.

A throttle valve 122 is disposed across the neck 126 of an outlet passage in the reservoir leading to intake port 98. The throttle valve 122 is manually operated via linkage 124. The carburetor 58 suitably operates on demand as hereinbefore mentioned. However, a linkage may be provided so as to operate a throttle valve, associated with a more conventional carburetor, in coordination with operation of throttle valve 122.

In operation of the engine according to the first embodiment, air is received through conduit 64 into the carburetor which supplies a fuel-air mixture in venturi 60 on demand via reed valve 52 into the crankcase chamber under the piston portion 26 and around the crankshaft, as the piston moves upwardly. As the piston then moves downwardly on the next portion of the cycle, the fuel-air mixture in the crankcase chamber underneath piston portion 26 is compressed. When the shoulder 28 of piston portion 26 passes ports 84, the fuel-air mixture is admitted into annular chamber 36 above piston shoulder 28. Then, as the piston moves upwardly in the next portion of the cycle, the fuel-air mixture in annular chamber 36 is compressed into reservoir 16 via conduit 90, smoothly flowing around the interior wall of the reservoir.

The displacement of piston portion 26 on the downward stroke in the crankcase chamber is larger than the displacement of either piston portion 26 or 24 into chambers 36 and 30 on the upward stroke. Moreover, intake valve 100 opens only after every other compression cycle. Therefore considerable compression is attained in reservoir 16 for supercharging the engine. Inasmuch as substantial pressure is maintained within reservoir 16, the supercharged engine according to the present invention is quite responsive to throttle operation, and, of course, engine horsepower is substantially increased as a result of supercharging to a pressure on the order of 15 p.s.i. The supercharging effect is produced utilizing the same connecting rod and crankshaft structure as in a conventional engine and in little more than the same space as would be occupied by the engine without supercharging.

The top piston portion 24 is fairly small in diameter and is provided with a pair of spark plugs. Consequently substantially complete combustion is attained with reduced detonation as immediate combustion takes place across the top of the small piston portion in the two combustion regions. In view of the substantial supercharging provided, the compression ratio in the top cylinder is suitably determined to be approximately 6.5 to 1 which is somewhat lower than might be employed in non-supercharged engines of a similar size.

Figure 5:
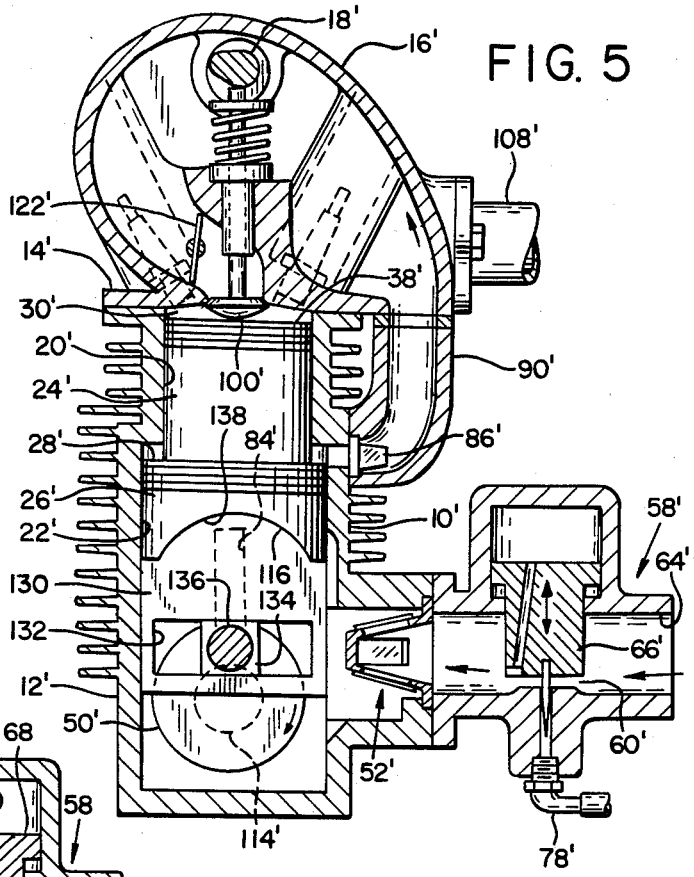
FIG. 5 is a vertical cross-sectional view of an engine according to an alternative embodiment of the present invention showing the piston thereof in its uppermost position.
Figure 6:
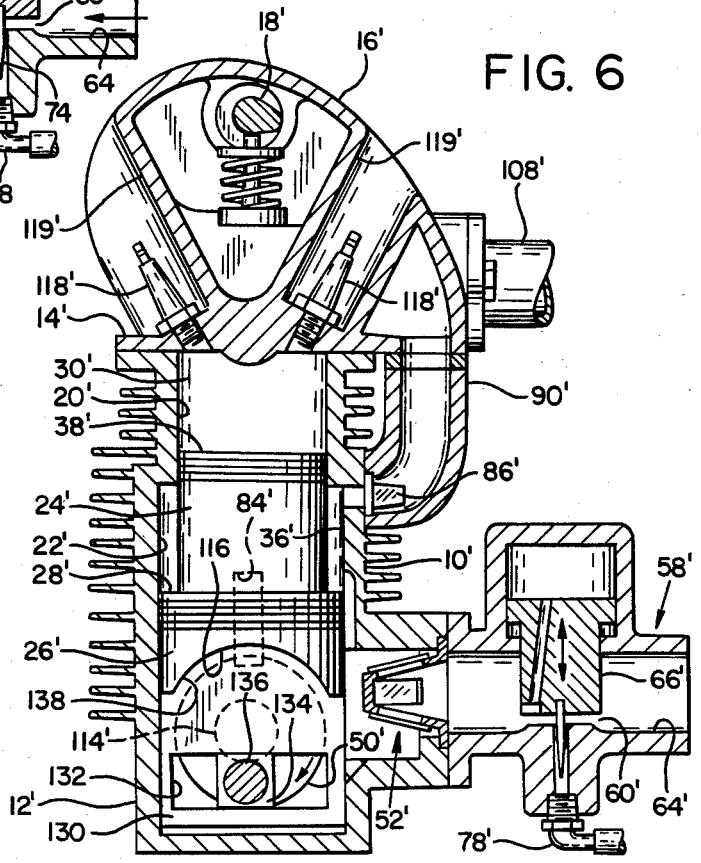
FIG. 6 is a vertical cross-sectional view of the embodiment of FIG. 5 illustrating the piston thereof in its lowermost position.
Figure 9:
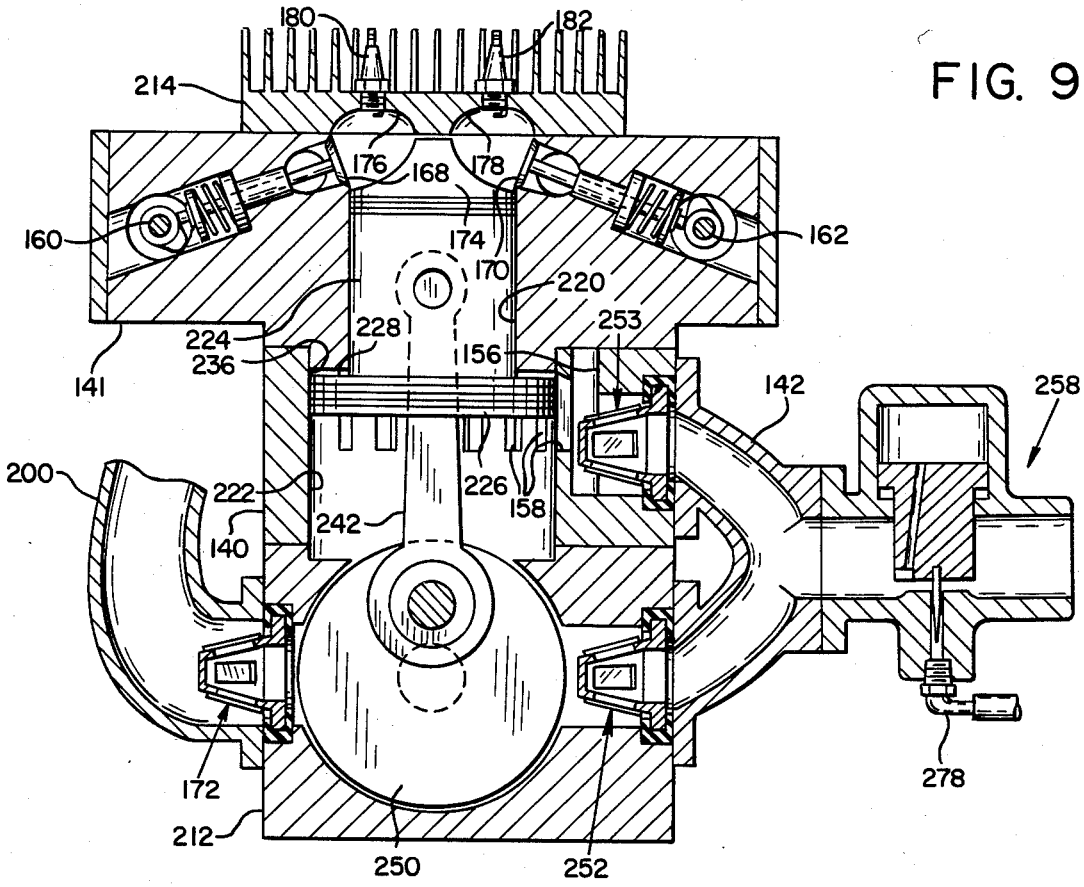
FIG. 9 is a vertical cross-sectional view of the FIG. 7 engine taken laterally through the exhaust valves thereof, with the piston in its uppermost position.
Figure 10:
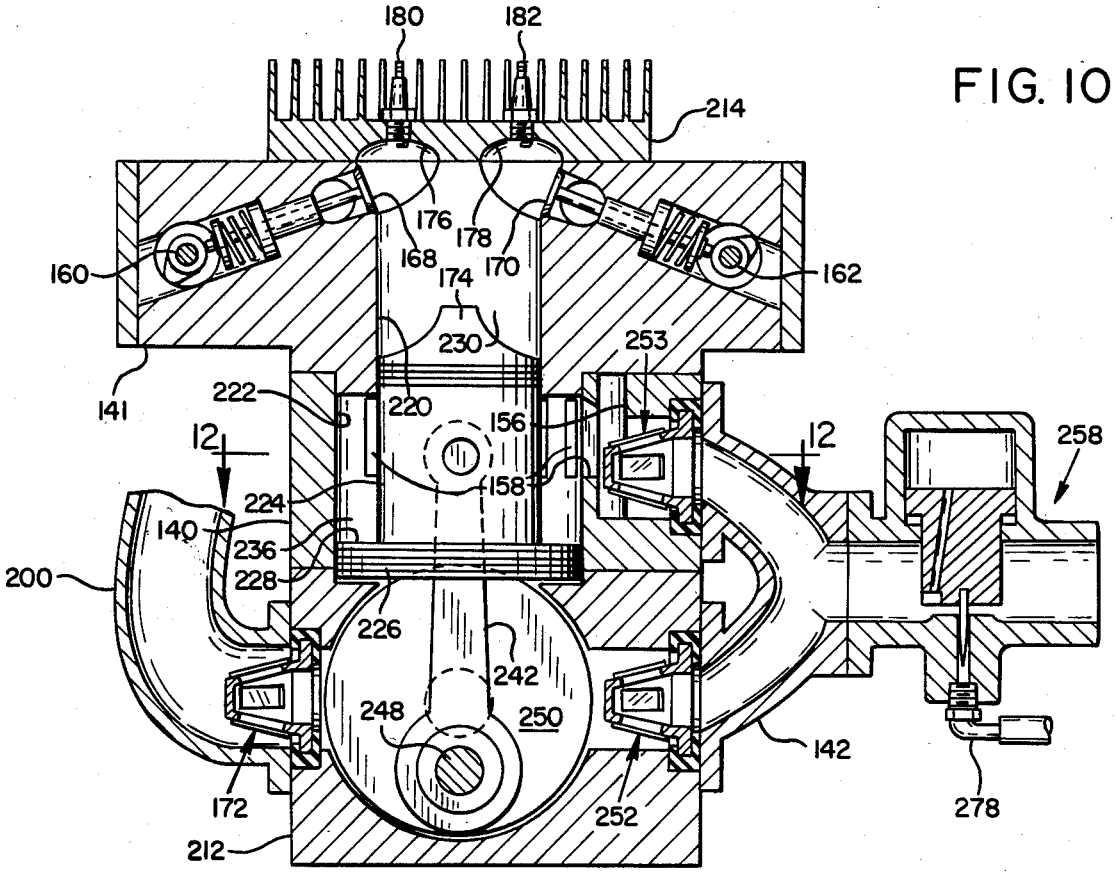
FIG. 10 is a vertical cross-sectional view of the FIG. 7 engine taken laterally through the exhaust valves thereof, with the piston in its lowermost position.

Referring to FIGS. 5 and 6, illustrating a second embodiment according to the present invention wherein primed reference numerals refer to elements substantially corresponding to similarly numbered elements in the first embodiment, an engine is illustrated which employs a scotch yoke drive in place of the conventional connecting rod. The engine is illustrated in FIG. 5 with the compound piston 24', 26' in its upwardmost position, e.g. at the end of the compression stroke, and is illustrated in FIG. 6 in its downwardmost position, e.g. at the end of the power stroke. A crankshaft is formed by disks 50' respectively joined to drive shaft 114' and connected together by crank portion 136. Crank portion 136 is rotatably received in bearing block 134 which is slidable horizontally along a slot 132 in bar 130 depending centrally from piston portion 26'. The bar 130 is of appropriate width to be received between disks 50' such that as the piston reciprocates, the disks 50' and the drive shaft are caused to rotate, bearing block 134 sliding back and forth in slot 132.

The piston portion 26' is provided with a lower skirt 138 above bar 130 which is recessed upwardly in somewhat semicircular fashion to accommodate disks 50' when the compound piston is in its lowermost position as illustrated in FIG. 6. When the compound piston then moves upwardly, a fuel-air mixture from carburetor 58' is drawn through reed valve 52' into the crankcase chamber around disks 50' and on either side of bar 130 below piston skirt 138. Ports 84' are positioned such that as piston portion 26' approaches its lowermost position, thus compressing the fuel-air mixture in the crankcase chamber, the ports 84' will be exposed to communicate between the crankcase chamber at the lower end of skirt 138, and the annular chamber 36' above stepped shoulder 28' of the piston. The scotch yoke embodiment provides a compact and low friction configuration, and in other respects operates in a manner substantially similar to that described in respect to the first embodiment.

In accordance with a third and preferred embodiment, illustrated in FIGS. 7 through 13, instead of the gaseous mixture being provided to the annular chamber from the crankshaft chamber, the gaseous mixture is delivered to the crankshaft chamber from the annular chamber. The crankshaft chamber is additionally supplied directly from the carburetor whereby an overall increased volume of compressed mixture can then be provided from the crankshaft chamber to the reservoir for delivery to the combustion chamber. Referring to FIGS. 7 through 13, a four-stroke supercharged engine includes a block comprising a lower portion 140 as well as an upper or valve portion 141. The engine further includes a crankcase 212 and a head 214. The block is provided with an upper bore or cylinder portion 220 and a lower, coaxial counterbore or cylinder portion 222 which is larger in diameter than the upper bore. Within the bore and counterbore is received a stepped piston comprising a first smaller diameter portion 224 slidably received in upper bore 220 and a second larger diameter portion 226 jointed to the first and slidably received in counter bore 222, with an upper shoulder 228 being formed at the top of a larger piston portion where the two piston portions join. A combustion chamber 230 is formed above this smaller piston portion 224 in bore 220, while the region below piston portion 226 in counterbore 222 and in the crankcase comprises a sealed crankcase chamber.

An intermediate annular chamber 236 is defined within the larger diameter bore 222 and around the smaller diameter piston 224 above stepped shoulder 228 of piston portion 226, said chamber being variable in volume according to the position of the lower piston portion. As in the previous embodiments, the area of shoulder 228 at the top of the piston portion 226 is suitably substantially equal to the cross-sectional area at the head end of the smaller piston portion 224 whereby the displacement of the bottom end of piston portion 226 is approximately twice that of the head end.

A connecting rod 242 is joined by wrist pin 244 to the combined piston, and by a bearing to a crank portion 248 of the crankshaft which is carried in crankcase 212. The volume of the crankcase is reduced by providing counterweight stuffer disks 250 which form a part of the crankshaft together with crank portion 248. Reed valve 252 is disposed in a passage at one side of the crankcase and communicates gaseous mixture into the crankcase from carburetor 258. The reed valve is formed and operates in the same manner described in connection with the first embodiment, and the carburetor 258 is of substantially the same type as hereinbefore described.

The carburetor 258, receiving gasoline from tubing 278, supplies gaseous mixture via conduit 142 to reed valve 252, and also supplies gaseous mixture to reed valve 253 for communicating with annular chamber 236 above piston shoulder 228. The reed valve 253 is located between conduit 142 and a partially cylindrically shaped cavity 156 disposed around bore 222 in block portion 140. (See especially FIG. 12.) The cavity 156 communicates to the bore 222 through a plurality of substantially evenly spaced, vertical ports 158 positioned so as to communicate between the crankcase chamber and the annular chamber 236 as the compound piston approaches its upwardmost position. Vertical ports 158 thus form valve means for supplying gaseous mixture from the annular chamber 236 to the crankcase chamber below piston portion 226.

On the downward stroke of the compound piston, gaseous mixture will be drawn into annular chamber 236 through ports 158 from reed valve 253, but on the following upward stroke of the compound piston, reed valve 253 will be closed whereby such mixture is compressed in the annular chamber and cavity 156 until the lower end of piston portion 226 passes the lower extent of ports 158 at which time the compressed gaseous mixture is delivered to the crankcase chamber. For most of the upward stroke of the compound piston, the crankcase chamber will have also been filling with gaseous mixture through reed valve 252. Consequently, the crankcase chamber receives gaseous mixture through both routes and then compresses the same on the following downward stroke of the compound piston into a pressure tank or reservoir 216 by way of reed valve 172, which is located on the opposite side of the crankcase 212 from reed valve 252, and conduit 200 disposed between reed valve 172 and reservoir 216. If, for example, the displacement of the smaller piston portion 224 into the combustion chamber, as well as the displacement of shoulder 228 into the annular chamber, are each fifteen cubic inches, then the displacement of the lower piston portion 226 in respect to the crankcase is thirty cubic inches. Since the compressed mixture from the annular chamber is added in the crankcase chamber, the effective displacement of the latter is then approximately forty-five cubic inches. The connecting rod 242, closely received between disks 250, aids in moving gaseous mixture through reed valve 172 in that the connecting rod operates as a vane pump in the latter part of the piston downstroke as the disks 250 move in a clockwise direction.

Reservoir 216 is secured to the forward side of block portion 141 where it holds pressurized fuel-air mixture received from the crankcase chamber. Passages 152 in block portion 141 lead from reservoir 216 to respective intake valves 164 and 166 located in block portion 141, the passages 152 being adjustably closed by throttle valves 150 operated in tandem by means of linkages 148 and cable 154. Each of the intake valves is oriented angularly upwardly and is positioned at an opposite side of combustion chamber 230. Rearwardly of the intake valves and similarly disposed in block portion 141 are exhaust valves 168 and 170 which communicate through passages in the block portion to exhaust manifold 144 connected to exhaust pipe 146 at the rear of the engine. The respective sets of valves are operated from dual cam shafts 160 and 162 extending from front to rear through the block portion 141 and provided at their rearward ends with gears 192 and 194 respectively driven by timing belt 190 engaging gear 188 on drive shaft 198. The timing belt, between gears 192 and 194, also passes under idler 196. As will be appreciated, the diameter of each of the gears 192 and 194 is twice that of gear 188 to facilitate four-stroke cycle operation. The timing belt and gears are enclosed in cover 202. The drive shaft and cam shafts are suitably lubricated via ducting 204, which is connected to the bottom of reservoir 216 so as to receive lubricating oil as may be provided with the fuel.

The engine of this embodiment, as in the case of the previous embodiments, is provided with a pair of spark plugs, here numbered 180 and 182, received through threaded apertures in head 214. Piston 224 includes an upwardly curved and somewhat pyramidal shaped top 174 which divides the combustion chamber 230 into substantially two parts at the top of the piston stroke as illustrated, for example, in FIG. 9. The combustion chamber parts are upwardly formed by concave recesses 176 and 178 located in the head 214 and into which spark plugs 180 and 182 extend. Each of the combustion chamber parts has its own intake valve and exhaust valve and therefore operates on an almost independent basis. A dome of combustible mixture is provided on each side of the piston top 174, and, when ignition takes place by firing both spark plugs at substantially the same time, the flame front doesn't have far to travel in each part. Combustion is improved and detonation, as may otherwise form a problem in a supercharged engine, is inhibited. As the piston moves downwardly in the power stroke, of course, an overall turbulence occurs in the combusting mixture which is then united.

Reviewing operation of the four-stroke engine according to this embodiment, air is received through carburetor 258 and mixed with gasoline from tube 278 to provide a fuel-air mixture which is then coupled by way of conduit 142 to both the crankcase chamber and annular chamber via reed valves 252 and 253. When the compound piston moves downwardly, fuel-air mixture is drawn into annular chamber 236. Then when the piston moves upwardly, the fuel-air mixture in chamber 236 is compressed while further fuel-air mixture is drawn into the crankcase chamber through reed valve 252. It is noted the carburetor is almost constantly "breathing". When the bottom portion of the piston passes ports 158, on the piston upward stroke, the compressed mixture from the annular chamber is conveyed into the crankcase chamber whereby the crankcase chamber starts out with essentially a higher pressure at the beginning of the down stroke then would be the case if fuel-air mixture were only drawn into the crankcase chamber through reed valve 252. The downwardly moving piston compresses the fuel-air mixture into reservoir 216 through conduit 200 wherein substantial pressure builds up for admission to the two-part combustion chamber 230 at every other upward stroke of the piston. This engine has the advantages of the previous embodiment, but also has the ability to provide additional overall supercharging pressure especially at higher speeds. As in the case of the previous embodiments, a relief means may be provided for communicating fuel-air mixture from the reservoir 216 back into the crankcase chamber as desired.

Referring to FIG. 14, illustrating a yet further embodiment of the present intention wherein primed reference numerals refer to elements substantially corresponding to similarly numbered elements in the last described embodiment, a portion of an engine is illustrated which is in all respects similar to that of the embodiment of FIGS. 7–13 except for the valving arrangement and the position of the spark plugs. The valves, for example exhaust valves 206 and 208, are located in head 274 and are operated from rocker arms 264 and 266 engaged by cams on cam shaft 268, the latter being turned in a conventional manner for a four-stroke engine by means of a timing belt (not shown). A valve cover 276 is located at the top of the head. As in the last embodiment, the combustion chamber is divided into two parts by the upwardly curved and somewhat pyramidal top portion 174' of the piston, with there being an intake valve and an exhaust valve communicating with each of the upwardly domed recesses 176' and 178' in head 274. In this embodiment, the spark plugs 270 and 272 are threadably received in wells in the sides of block portion 141' and extend somewhat angularly upwardly into the two parts of the combustion chamber. Although the engine depicted in FIG. 14 requires only one cam shaft and is somewhat more conventional than the engine of the just previously described embodiment in that respect, nevertheless the previous embodiment is preferred because the engine is shorter, not being of the overhead cam type.

Although engines have been described which each employ a single piston and cylinder, it will be apparent that these engines are easily expanded into multiple cylinder versions without departing from the teaching of the present invention. Moreover, although engines are described having carburetors for supplying fuel-air mixture first to a crankcase chamber or annular chamber for compression, it will be appreciated the carburetor can be located elsewhere in the compression sequence whereby air alone is supplied for initial compression. Alternatively, fuel injection may be employed.

While I have shown and described plural embodiments of my invention, it will be apparent to those skilled in the art that many other changes and modifications may be made without departing from my invention in its broader aspects. I therefore intend the appended claims to cover all such changes and modifications as fall within the true spirit and scope of my invention.

I claim:

1. In a four-cycle internal combustion engine, a housing including a cylinder having a first portion with a first diameter and a second coaxial portion with a second and larger diameter, a stepped piston having a first smaller diameter portion slidably received in the first portion of said cylinder, and a second larger diameter portion joined to the first at a stepped shoulder so as to be simultaneously slidably received in the second portion of said cylinder, a combustion chamber defined in said housing adjacent the end of the small diameter portion of the piston, a crankcase chamber defined in said housing opposite the larger diameter end of the piston, an intermediate annular chamber within the larger diameter cylinder portion around the smaller diameter piston portion, said annular chamber being variable in volume according to the position of said stepped shoulder of the larger diameter portion of said piston, means for introducing gas into said intermediate annular chamber for compression therein, said gas introducing means further including means for introducing gas at substantially atmospheric pressure into said crankcase chamber, means for coupling compressed gas from said intermediate annular chamber into said crankcase chamber to mix with the gas previously introduced therein, and means for introducing compressed gases from said crankcase chamber into said combustion chamber.

2. The engine according to claim 1 wherein said means for introducing the compressed gases from said crankcase chamber into said combustion chamber includes a reservoir chamber holding the compressed gases for said combustion chamber, and an intake valve located between said reservoir chamber and said combustion chamber, said reservoir chamber being defined in said housing adjacent said combustion chamber and having smoothly curved interior walls directing the compressed gases around the interior of said reservoir chamber toward the intake valve.

3. In a four-cycle internal combustion engine including a piston having a smaller diameter portion and a larger diameter portion;

an engine block and a head, the engine block having a cylinder receiving said piston reciprocally movable therein and providing only a single combustion chamber adjacent the smaller diameter portion of said piston and closed by the head, an annular chamber being formed along said cylinder and closed by said larger diameter portion of said piston;

a crankshaft driven by said piston;

an enclosed crankcase;

means for supplying a gaseous input to said engine for compression in said enclosed crankcase by the larger diameter portion of said piston during a downstroke thereof;

means for enabling delivery of the gaseous input compressed in said crankcase to said annular chamber for further compression therein during an upstroke of said piston;

a reservoir receiving said gaseous input compressed in said annular chamber, the improvement comprising:

the gaseous input to said crankcase being a sole source of fuel for operating said engine; and a reservoir being integral with the head and having smoothly curved interior walls for directing the compressed gaseous input around the interior of the reservoir toward an intake port of said combustion chamber.

4. The engine according to claim 3, further comprising:

a face of the piston inside the combustion chamber having a raised region extending into the combustion chamber across the face of the piston and essentially bifurcating the combustion chamber into two combustion regions when the piston is fully extended into the cylinder; and a spark plug disposed in each of the combustion regions.

5. The engine according to claim 4, further comprising:

an intake valve and an exhaust valve opening into each of the two combustion regions.

6. In a four-cycle internal combustion engine including a piston having a smaller diameter portion and a larger diameter portion;

an engine block and a head, the engine block having a cylinder receiving said piston reciprocally movable therein and providing only a single combustion chamber adjacent the smaller diameter portion of said piston, the combustion chamber being closed by said head, an annular chamber being formed along said cylinder and closed by the larger diameter portion of said piston;

a crankshaft driven by said piston;

an enclosed crankcase housing said crankshaft;

means during an upstroke of said piston for supplying a gaseous input to said crankcase for compression therein by the larger diameter portion of said piston during a downstroke thereof, the improvement comprising:

means during the downstroke of said piston for supplying the gaseous input to said annular chamber for compression therein by the larger diameter portion of said piston during an upstroke thereof;

means for enabling delivery of the gaseous input compressed in said annular chamber to said crankcase for further compression therein with the gaseous input supplied to said crankcase during the upstroke of said piston;

a reservoir intermediate said crankcase and said combustion chamber and receiving the combined gaseous input compressed in said crankcase; and enabling delivery of the combined compressed gaseous input from said reservoir to said combustion chamber.

7. The engine according to claim 6, further comprising:

a face of the piston inside the combustion chamber having a raised region extending into the combustion chamber across the face of the piston and essentially bifurcating the combustion chamber into two combustion regions when the piston is fully extended into the cylinder; and a spark plug disposed in each of the combustion regions.

8. The engine according to claim 7, further comprising:

an intake valve and an exhaust valve opening into each of the two combustion regions.

9. A supercharged, four-cycle internal combustion engine, comprising:

a piston having a smaller diameter portion and a larger diameter portion;

an engine block and a head, said engine block defining a cylinder receiving said piston reciprocally movable therein and providing only a single combustion chamber adjacent the smaller diameter portion of said piston and closed by said head, the combustion chamber having an intake port and an exhaust port, an annular chamber being formed along the cylinder and closed by the larger diameter portion of said piston;

a connecting rod;

a crankshaft coupled to said piston by said connecting rod and driven by said piston;

an enclosed crankcase housing said crankshaft;

means for supplying a gaseous input for operation of said engine, the gaseous input being supplied only to said enclosed crankcase during an upstroke of said piston, the gaseous input being compressed in said enclosed crankcase by the larger diameter portion of said piston during a downstroke thereof;

means for enabling delivery of the gaseous input compressed in said crankcase to the annular chamber, the compressed gaseous input being further compressed in the annular chamber during the upstroke of said piston;

a reservoir receiving the gaseous input compressed in the annular chamber; and means for enabling delivery of the compressed gaseous input from said reservoir through the intake port to the combustion chamber substantially throughout alternate downstrokes of said piston following an exhaust cycle.

10. The internal combustion engine according to claim 9, wherein said reservoir is integral with said head and includes smoothly curved interior walls for directing the compressed gaseous input around the interior of said reservoir toward the intake port of the combustion chamber.

11. The internal combustion engine according to claim 9, further comprising:

a face of said piston inside the combustion chamber having a raised region extending into the combustion chamber across the face of said piston and essentially bifurcating the combustion chamber into two combustion regions when said piston is fully extended into the cylinder; and a spark plug disposed in each of the combustion regions.

12. The internal combustion engine according to claim 11, further comprising:

an intake valve and an exhaust valve opening into each of the two combustion regions.

* * * * *